United States Patent [19]

Harper

[11] 4,385,510

[45] May 31, 1983

[54] CYLINDER LOCKS

[76] Inventor: Barrie S. Harper, 27 Stubby La., Wednesfield, Wolverhampton, West Midlands, England, WV11 3NL

[21] Appl. No.: 331,719

[22] Filed: Dec. 17, 1981

Related U.S. Application Data

[63] Continuation of Ser. No. 129,805, Mar. 12, 1980, abandoned.

[30] Foreign Application Priority Data

Mar. 16, 1979 [GB] United Kingdom ..... 7909291

[51] Int. Cl.[3] ..... E05B 15/14; E05B 29/02

[52] U.S. Cl. ..... 70/364 R; 70/375; 70/377; 70/DIG. 42

[58] Field of Search ..... 70/364 R, 364 A, 368, 70/373, 375, 376, 377, DIG. 42

[56] References Cited

U.S. PATENT DOCUMENTS

| | | | |
|---|---|---|---|
| 1,755,847 | 4/1930 | Stevens | 70/364 A |
| 1,990,794 | 2/1935 | McCormac | 70/368 |
| 3,691,799 | 9/1972 | Hoffmann | 70/84 |
| 3,863,476 | 2/1975 | Patriquim | 70/419 |

FOREIGN PATENT DOCUMENTS

| | | | |
|---|---|---|---|
| 737547 | 9/1955 | United Kingdom | 70/364 R |
| 1030921 | 5/1966 | United Kingdom | 70/364 R |

*Primary Examiner*—Robert L. Wolfe

*Attorney, Agent, or Firm*—Pollock, Vande Sande & Priddy

[57] ABSTRACT

A cylinder lock includes two barrels (23, 37), a first (23) carrying tumblers (30) that abut internal shoulders (36) of the lock casing (2) to obstruct clockwise 'unlocking' rotation only, and the second (37) carrying a single tumbler (43) which obstructs only counter-clockwise 'locking' rotation by abutment with a shoulder (48) of a rear-end casing-cover (8). A key (5) inserted through a keyhole-defining assembly (11, 16, 21) withdraws the first-barrel tumblers (30) during initial clockwise turning from the insertion position, and the second-barrel tumbler (43) during initial counter-clockwise turning. Lost-motion coupling between the barrels (23, 37), provided by lug-in-slot (38, 39) interengagement, enables clockwise turning of the second barrel (37) with the key (5) relative to the first barrel (23) during withdrawal of the first-barrel tumblers (30), and corresponding counter-clockwise turning of the first barrel (23) relative to the second (37) during withdrawal of the second-barrel tumbler (43). Lug-in-slot coupling (22, 24) between the keyhole-defining assembly (11, 16, 21) and the first barrel (23) similarly allows initial slip for clockwise key-turning. A coiled spring (42) opposes resiliently second-barrel turning in both directions.

16 Claims, 30 Drawing Figures

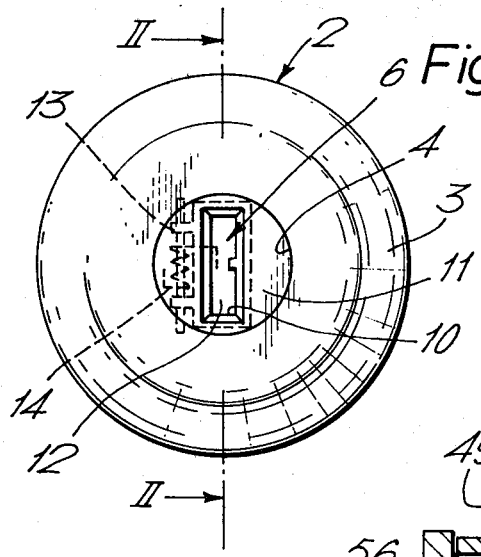
Fig.1.
Fig.2.
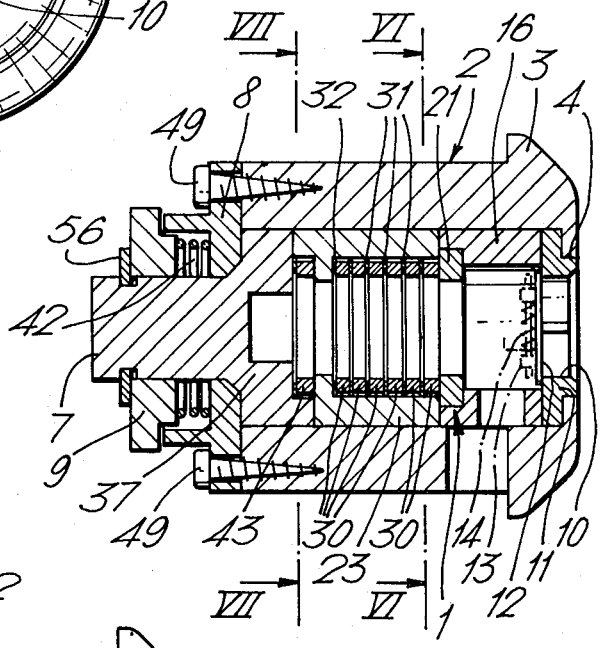
Fig.3.
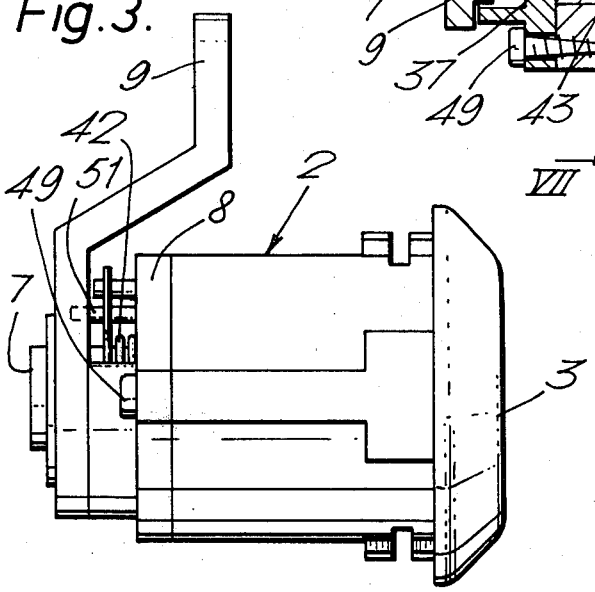

CYLINDER LOCKS

This is a continuation of application Ser. No. 129,805, filed Mar. 12, 1980 and now abandoned.

This invention relates to cylinder locks.

The invention is particularly concerned with cylinder locks of the kind in which one or more tumblers that are engaged by an inserted key continue to obstruct rotation within the lock until there is tumbler withdrawal by initial turning of the key from its position of insertion. Cylinder locks of this kind are described in United Kingdom Patent Specification Nos. 737,547 and 1,030,921, and have been utilized extensively and very successfully in diverse applications. Such locks offer a high degree of security and are especially resistant to picking. However certain characteristics of such locks, which whilst advantageous in these and other respects, have tended to limit their more general application. In particular the fact that tumbler withdrawal takes place only in response to the initial turning of the inserted key (rather than as with other more-widely known cylinder locks using spring-loaded tumblers, merely upon key-insertion) has precluded their application in circumstances where turning of the key in either of two directions from the position of insertion is desired for lock operation.

Such circumstances arise, for example, in the locking of motor-vehicle doors where, conventionally, the step of locking the door involves insertion of the key, turning it in one direction from the position of insertion and then returning it to the position of insertion for withdrawal, whereas the step of unlocking requires precisely the same procedure except that the direction of turning from the position of insertion is opposite to that required for locking. Known forms of lock of the kind referred to above are incapable of practical application in such circumstances. More particularly with the known forms of such locks tumbler withdrawal occurs only in response to turning of the key in one direction from the position of insertion, and turning of the key in the opposite direction to return it to its position of insertion prior to withdrawal of the key, extends the tumblers to project from the barrel and obstruct its rotational freedom once again. Attempt to turn the key in this same, opposite direction from the position of insertion merely acts to establish more firmly the obstructing projection of the tumblers from the barrel.

It is one of the objects of the present invention to provide a lock of the above-specified kind that may be used to overcome the above-mentioned limitation of known forms of lock of this kind.

According to one aspect of the present invention there is provided a cylinder lock in which one or more tumblers project from a barrel to obstruct rotation of the tumbler mechanism of the lock, and a key inserted into the tumbler mechanism engages with the one or more tumblers to withdraw them by initial turning of the key in one direction from its position of insertion, wherein the one or more tumblers obstruct rotation of the barrel in the said one direction only, the mechanism includes one or more further tumblers which obstruct rotational freedom of the mechanism in the opposite direction and which are also engaged by the inserted key for their withdrawal from such obstruction, and the tumbler mechanism includes provision for slip relative to the barrel in the key-engagement with the one or more further tumblers during the said initial turning of the key in said one direction.

With the cylinder lock of the above aspect of the present invention separate sets of one or more tumblers are used for obstructing rotation in the two directions, allowance for the initial turning of the key in the said one direction relative to the barrel and required to withdraw tumbler-obstruction in that direction, being provided by slip within the mechanism. The one or more further tumblers may be carried by a separate barrel to project from this for obstructing rotation in the said opposite direction, and in these circumstances the specified slip may be incorporated in the mechanism as a lost-motion coupling between the two barrels. Such lost-motion coupling may be provided simply by a lug that projects from one of the barrels and engages in a slot of the other.

The one or more further tumblers may, like the first-mentioned tumblers, be such as to require initial turning of the key, in this case in the said opposite direction, for withdrawal. Where in these circumstances, two barrels intercoupled by a lost-motion coupling as referred to above are utilized, it is of advantage to incorporate a further lost-motion coupling into the tumbler mechanism. Such further lost-motion coupling may be incorporated into the mechanism between one of the barrels and a part which defines a keyhole to the forend of the lock and which turns with the inserted key, and may be arranged to allow slip between them only for turning of the keyhole-defining part through a limited angle in a first of the two directions from the position of key insertion. In these latter circumstances the lost-motion coupling between the two barrels will preferably allow turning of the said one barrel through only a limited angle in the second direction from the position of key insertion.

The same number of tumblers may be utilized for both sets of one or more tumblers, but where, for example, the lock is used for the door of a motor vehicle the lock security as regards locking can be significantly less than for unlocking. Accordingly it is readily possible to utilize just one tumbler for obstruction of turning in the locking direction, whereas in general more than one will be utilized for obstruction in the unlocking direction.

In the latter respect and according to another aspect of the present invention there is provided a key-operable cylinder lock in which tumblers act to obstruct rotation of a barrel of a tumbler mechanism of the lock, and a key inserted into the tumbler mechanism engages with the tumblers to withdraw them by initial turning of the key in one direction from its position of insertion so as thereby to enable further turning of the key in that same direction to effect unlocking, the tumblers act to obstruct rotation of the barrel in the said one, unlocking, direction only, the barrel being free from obstruction for rotation in the opposite, locking direction from the position of key insertion without withdrawal of the tumblers, and spring means, which may be in the form of a coiled spring, opposes resiliently rotation of the tumbler mechanism with the key in the locking direction from the position of key insertion.

A cylinder lock in accordance with the present invention will now be described, by way of example, with reference to the accompanying drawings, in which:

FIG. 1 is a view of the cylinder lock from its forend;

FIG. 2 is a sectional side-elevation of the lock taken on the line II—II of FIG. 1;

FIG. 3 is a plan view of the lock;

The lock illustrated in the accompanying drawings will be described in the context of its application to the locking of a door of a motor vehicle. In such application the locking of the door requires insertion of an appropriate key into the lock, turning of the key in one direction and then back to return it to the insertion position before withdrawal, whereas unlocking requires insertion of the key, turning in the opposite direction from that used for locking and then turning it back again to the insertion position before withdrawal.

Figure 7:
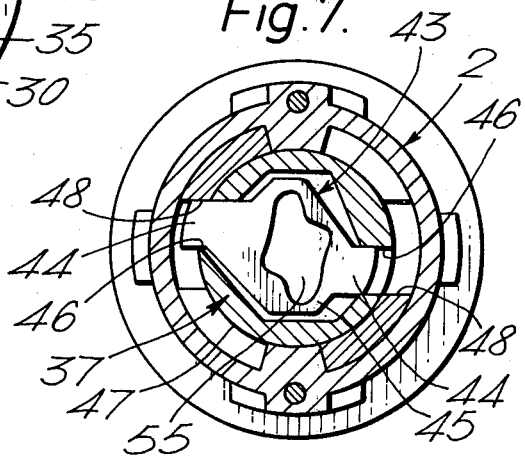
Figure 8:
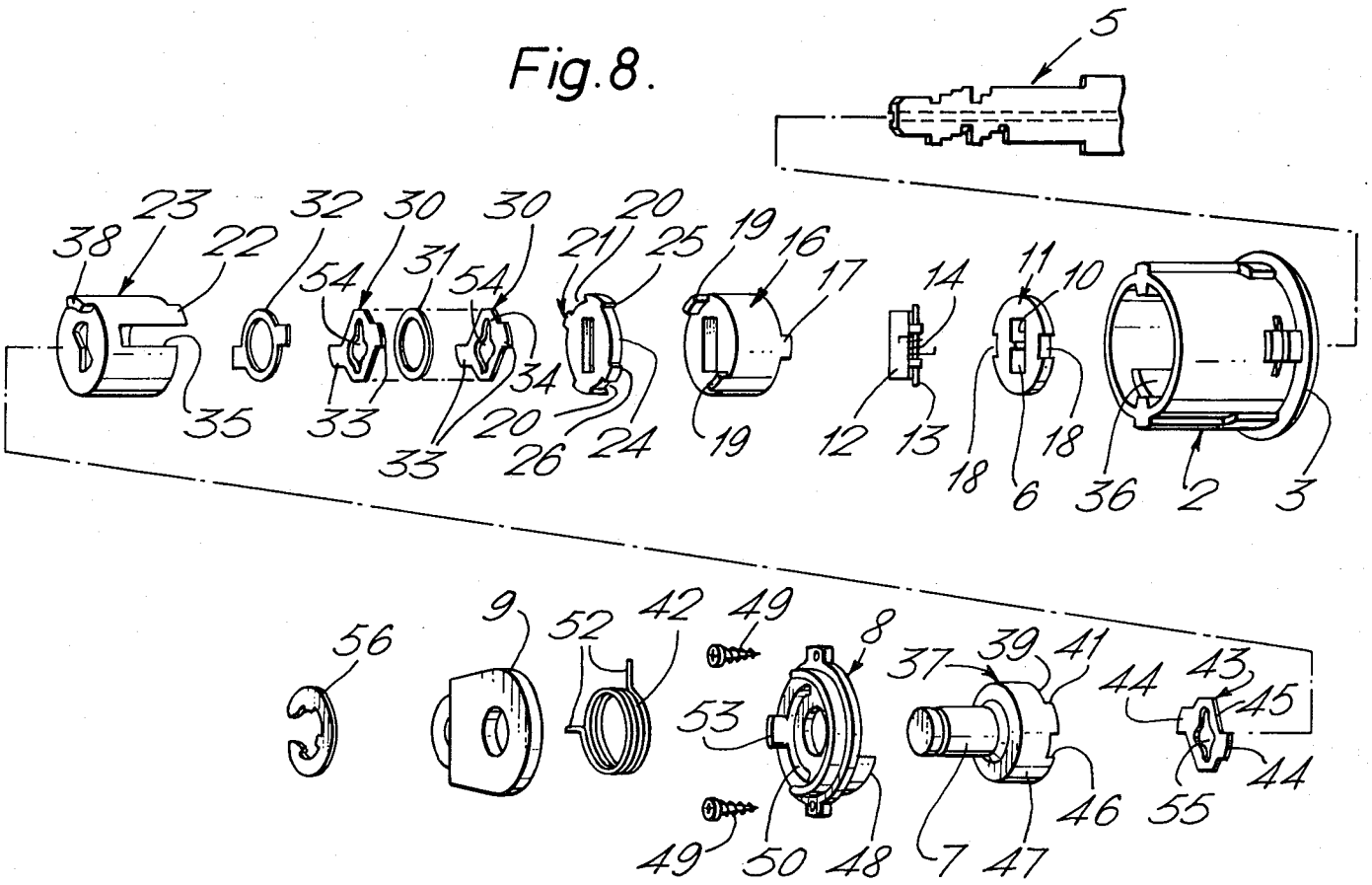
FIG. 8 is an exploded view of the lock.
Figure 9A:
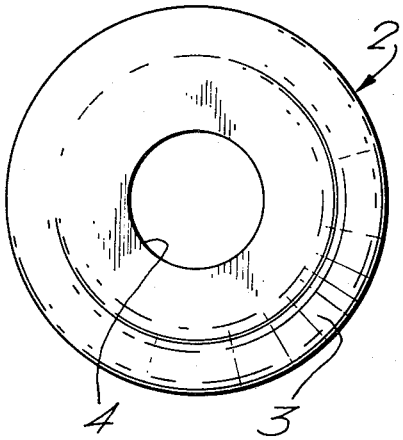
FIG. 9 shows at (a) and (b) forend and rear views of a casing of the lock.
Figure 9B:
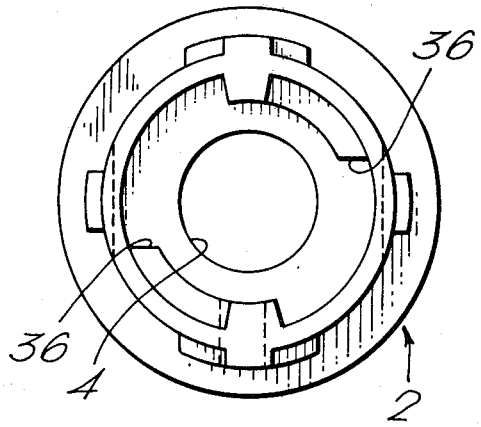

Referring to FIGS. 1 to 8, the key-operable tumbler mechanism 1 of the lock is contained within a cylindrical die-cast casing 2—shown in detail in FIG. 9—that has a flange 3 located at the forend of the lock. The flange 3, which is for use in clamping the lock in the vehicle door and which has a central aperture 4, provides an escutcheon for entry of the key 5 (FIG. 8) to a keyhole 6 of the mechanism 1 within the casing 2. A spindle 7 of the mechanism 1 projects through a cover 8 that closes the rear-end of the casing 2, and carries a lever 9 for coupling to the door latch (not shown). Until the appropriate key 5 is inserted in the keyhole 6 and turned, the mechanism 1 as a whole, is restrained from turning within the casing 2. However when the appropriate key 5 is inserted and turned, the mechanism 1 is freed to turn with the key through a substantial angle in either direction from the position of key insertion. The spindle 7 and lever 9 turn with the mechanism 1, and the door latch is responsive to the deflection of the lever 9 to lock or unlock the door according to the sense of the deflection. In the present case, clockwise rotation of the key—as viewed from the forend of the lock—is required to unlock the door, whereas counter-clockwise rotation is required to lock it. The lever 9 turns back upon return of the key to the key-insertion position for withdrawal, but the latch mechanism is unresponsive to this return movement, leaving the door locked or unlocked until the key is again inserted in the keyhole 6 and turned in the clockwise or counter-clockwise sense, respectively.

Figure 10A:
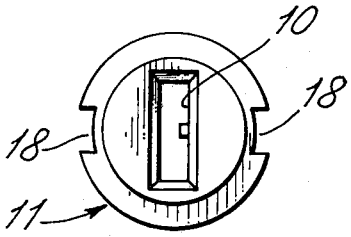
FIG. 10 shows at (a) to (c) front, side and sectional-side views of a disc-insert that is located to the forend of the casing of FIG. 9 in the mechanism of the lock.
Figure 10B:
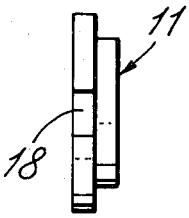
Figure 10C:
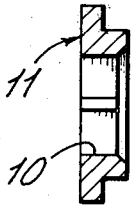
Figure 11A:
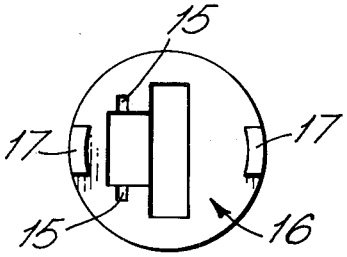
FIG. 11 shows at (a) to (c) front, side and rear views of a bush that engages with the disc-insert of FIG. 10 in the lock mechanism.
Figure 11B:
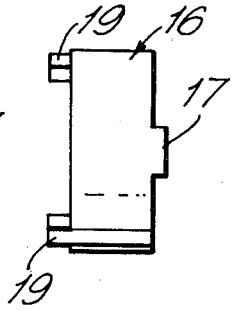
Figure 11C:
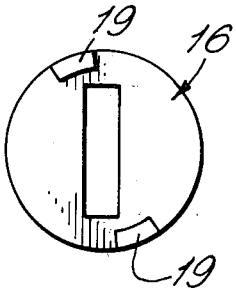

The keyhole 6 is defined by a rectangular slot 10 in a disc-insert 11—shown in detail in FIG. 10—that is located within the casing 2 and is seated within the aperture 4. A spring-biased shutter 12 closes the keyhole 6 behind the slot 10, the shutter 12 being pivoted on a spindle 13 and biased by a spring 14 to cover the slot 10. The ends of the spindle 13 are trapped within slots 15 in a bush 16—shown in detail in FIG. 11—that abuts the insert 11, so that under the thrust of the key 5 entering the keyhole 6, the shutter 12 pivots back into the bush 16 on the spindle 13 against the bias of the spring 14.

Figure 12A:
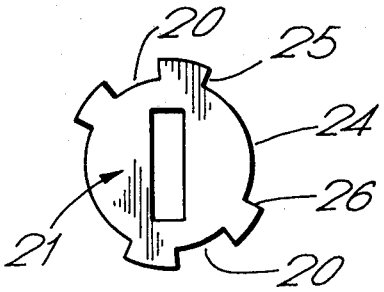
FIG. 12 shows at (a) and (b) front and side views of a disc that engages with the bush of FIG. 11 in the lock mechanism.
Figure 12B:
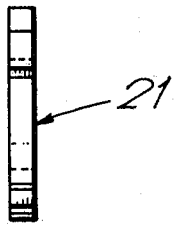
Figure 13A:
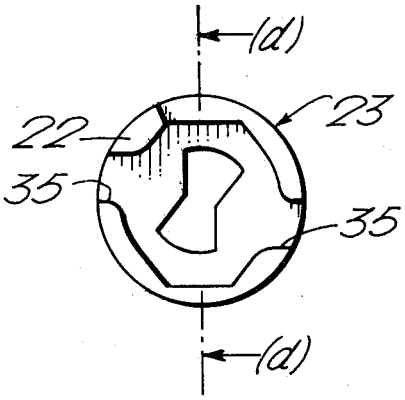
FIG. 13 shows at (a) to (d) front, rear, side and sectional-side views of one of two barrels forming part of the lock mechanism.
Figure 13B:
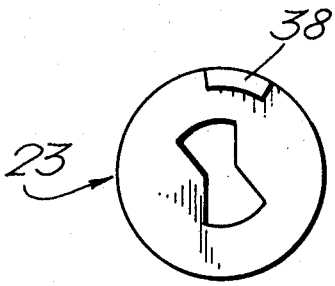
Figure 13C:
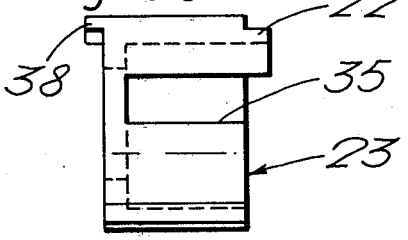
Figure 13D:
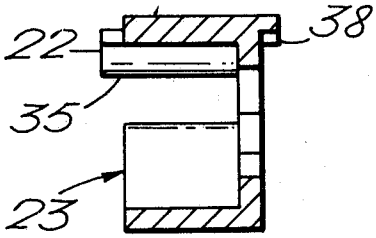
Figure 14A:
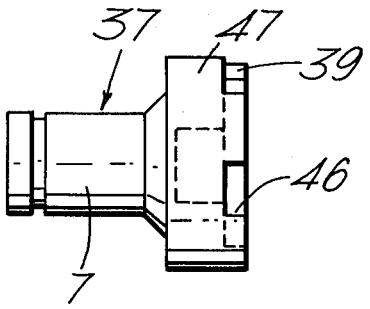
FIG. 14 shows at (a) to (d) side views and front and rear views of the other barrel of the lock mechanism.
Figure 14B:
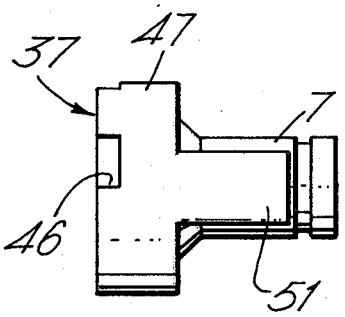
Figure 14C:
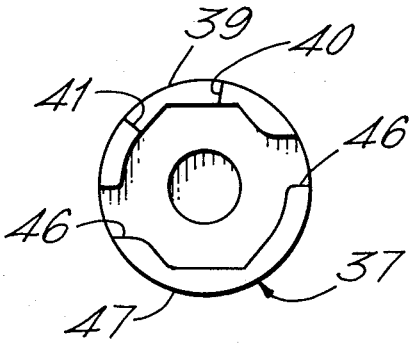
Figure 14D:
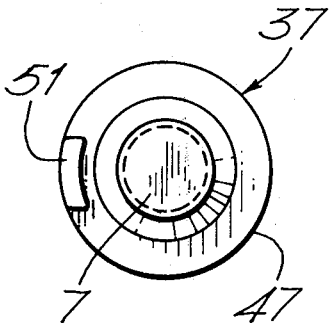
Figure 15A:
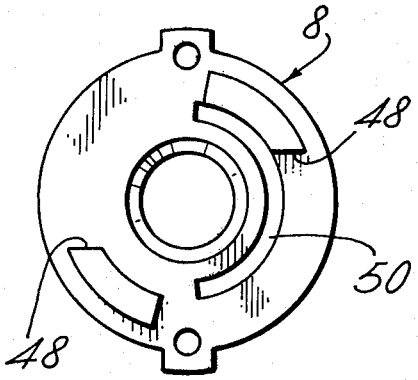
FIG. 15 shows at (a) to (d) front, rear, side and plan views of a cover that serves to close the casing of FIG. 9, in the lock.
Figure 15B:
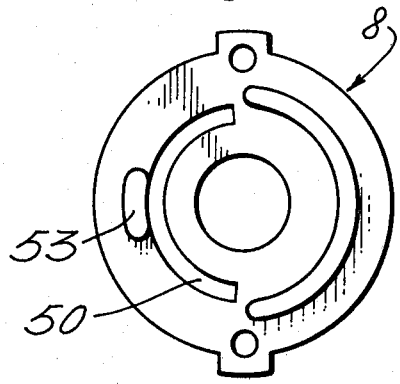
Figure 15C:
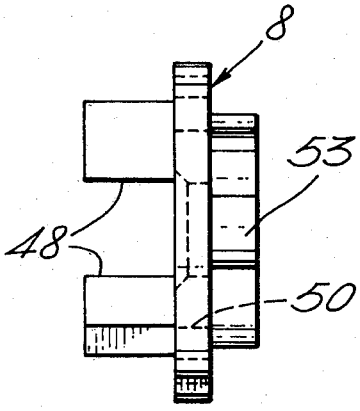
Figure 15D:
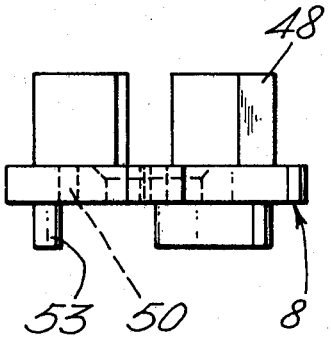

The bush 16 has two forwardly-projecting lugs 17 that engage tightly with slots 18 in the periphery of the insert 11, and two rearwardly-projecting lugs 19 that similarly engage with slots 20 in the periphery of a slotted disc 21—shown in detail in FIG. 12—that abuts the rear of the bush 16 in the assembly. The insert 11, bush 16 and disc 21 intercoupled in this way are free to rotate as one together within the casing 2 except to the extent that such turning is limited by a lug 22 that projects forwardly from a cup-shape barrel 23—shown in detail in FIG. 13—into a large slot 24 having flanks 25 and 26 in the periphery of the disc 21. The lug 22 normally abuts the flank 25 of the slot 24 so as to urge the barrel 23 to turn with the intercoupled insert 11, bush 16 and disc 21 in the counter-clockwise sense; the intercoupled insert 11, bush 16 and disc 21 may however rotate to a substantial extent in the opposite, clockwise sense free of the barrel 23.

Figure 4:
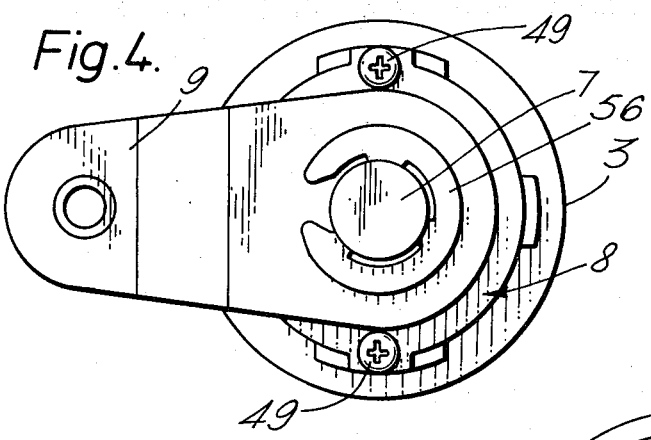
FIGS. 4 and 5 are end elevations of the lock, with and without, respectively, an operating lever.
Figure 5:
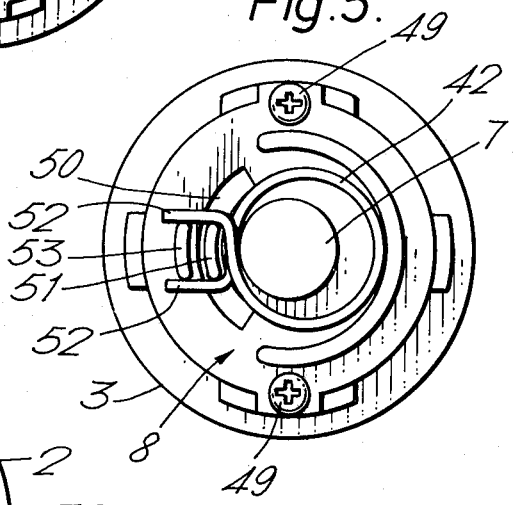
Figure 6:
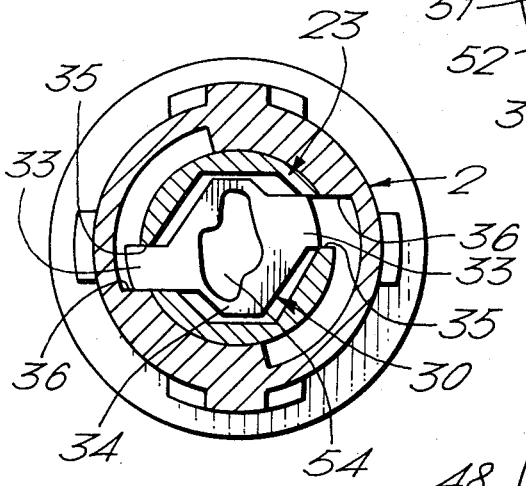
FIGS. 6 and 7 are sectional end views of the lock taken on the lines VI—VI and VII—VII respectively of FIG. 2.

The barrel 23 contains a pack of six tumblers 30 (of which only two are shown in FIG. 8) that are separated one from the other by five washers 31 (of which only one is shown in FIG. 8) and are urged tightly together and onto the rear of the disc 21 by a dished spring-washer 32. Each tumbler 30 has two arms 33 that extend in opposite directions to one another from an apertured bellied-portion 34 into two slots 35 respectively in the cylindrical wall of the barrel 23. The inside configuration of this wall (see (a) of FIG. 13 especially) is such as to enable each tumbler 30 freedom to move transversely of the barrel 23 with its arms 33 sliding in the slots 35 (see FIG. 6). The overall width of each tumbler 30 measured across the arms 33 equals the external diameter of the barrel 23, and according to the transverse location of the individual tumbler 30 within the barrel 23, so either it is withdrawn to be contained wholly within the compass of the barrel 23, or one or the other of its two arms 33 projects. It is only when all six tumblers 30 are withdrawn into the barrel 23 so that none of the arms 33 projects therefrom, that the barrel 23 is freed for turning in the clockwise sense; turning of the barrel 23 in this sense is otherwise obstructed, (as illustrated in FIG. 6), by abutment of those of the arms 33 that project (in either direction) from the barrel 23, with shoulders 36 within the cylindrical casing 2.

The barrel 23 is free to turn in the counter-clockwise sense within the casing 2 whether or not any of the arms 33 project, except to the extent that such turning is restrained by a second barrel 37—shown in detail in FIG. 14—that incorporates the rearwardly-projecting spindle 7. In this respect, the barrel 23 has a rearwardly-extending lug 38 that is engaged with a slot 39 in the barrel 37, the angular extent of the slot 39 between its flanks 40 and 41 being such as to allow twenty degrees of slip or lost motion in rotation between the two barrels 23 and 37. The barrel 37 is biased—under the action of a coiled spring 42 mounted externally of the casing 2—into the condition in which the flank 40 normally abuts the lug 38. In this condition the lost-motion inter-coupling of the barrels 23 and 37 enables the barrel 23 to turn through twenty degrees in the counter-clockwise sense independently of the barrel 37, or the barrel 37 to turn through twenty degrees in the clockwise sense independently of the barrel 23, before the lug 38 abuts the flank 41. The barrel 37 is however itself free to turn in the counter-clockwise sense against the bias of the spring 42, in dependence upon the transverse location therein of a single tumbler 43.

The tumbler 43, like the tumblers 30, has two arms 44 that extend in opposite directions to one another from an apertured bellied-portion 45. The two arms 44 extend into two slots 46 respectively in a cylindrical portion 47 of the barrel 37, and the inside configuration of the portion 47 (see (c) of FIG. 14 especially) is such as to enable the tumbler 43 to move transversely of the barrel 37 with the arms 44 sliding in the slots 46 (see FIG. 7). The overall width of the tumbler 43 across the arms 44 is equal to the external diameter of the portion 47, and according to the transverse location of the tumbler 43 within the barrel 37, so either it is withdrawn to be contained wholly within the compass of the portion 47, or one or the other of its arms 44 projects transversely from it. It is only when the tumbler 43 is withdrawn that the barrel 37 is freed for turning in the counter-clockwise sense; such turning is otherwise obstructed, as illustrated in FIG. 7, by the projection of one or the other of the arms 44 from the barrel 37 to abut with one or the other of two shoulders 48 that project forwardly within the casing 2 from the cover 8—shown in detail in FIG. 15.

The cover 8, which is clamped to the casing 2 by screws 49, is pierced by an arcuate slot 50 of almost semicircular extent, coaxial with the spindle 7. It is through this slot 50 that a rearwardly-extending lug 51 (see (b) and (d) of FIG. 14 especially) of the barrel 37 projects to be engaged by the coiled spring 42 and make driving engagement with the lever 9, externally of the casing 2. The spring 42 embraces the spindle 7 and its two ends 52 are crossed to extend on either side of the lug 51 and engage with a rearwardly-extending lug 53 located on the cover 8 mid-way round the slot 50. Thus turning of the barrel 37 in either sense within the casing 2 to deflect the lever 9, is opposed resiliently by the engagement of the lug 51 with one or other end 52 of the spring 42 to restore the barrel 37, and with it the lever 9, to its normal angular position.

Insertion of the key 5 in the lock engages it in the apertures 54 of the tumblers 30 and also in the aperture 55 of the tumbler 43. When the apertures 54 and 55 are in register with one another appropriately to receive the key, the tumblers 30 and 43 are then all positively located to obstruct rotation, that is to say, one or other of the arms 33 of each tumbler 30 and one or other of the arms 44 of the tumbler 43, project from the respective barrels 23 and 37. Withdrawal of the tumblers 30 or of the tumbler 43 takes place only in response to turning of the key 5 from its position of insertion in, respectively, the clockwise or counter-clockwise sense to unlock or lock the door.

The intercoupled insert 11, bush 16 and disc 21 turn freely with the key 5 within the casing 2. If the key is turned from its position of insertion in the clockwise sense (to unlock the door), the initial turning is not followed by the barrel 23 since clockwise turning of the barrel 23 is obstructed by the abutment of the tumblers 30 with the shoulders 36 of the casing 2. Turning of the barrel 37 in this sense is not however obstructed by the tumbler 43, and the engagement of the key within the aperture 55 of the tumbler 43 turns the barrel 37 with the key against the bias of the spring 42. As the key turns therefore, so contact of the lugs 38 and 22 of the barrel 23 with the slot-flanks 40 and 25 of the barrel 37 and disc 21 respectively, is broken leaving the barrel 23 stationary.

Engagement of the clockwise-turning key within the apertures 54 of the tumblers 30 acts to displace them transversely within the barrel 23. Provided the cut of the key is appropriately-related to the aperture-configuration in each case, all tumblers 30 are withdrawn together into the barrel 23 in response to some twenty degrees, or less, of initial turning of the key from its position of insertion. Thus after the initial turning of the key, the barrel 23 becomes free to turn with the key and the rest of the mechanism 1. Turning of the key to the full extent to rotate the mechanism 1 and provide the clockwise deflection necessary to operate the door latch to unlock the door, can therefore be achieved in this case. On the other hand, the full extent of rotation in this respect is not possible if the wrong cut of key is used since the tumblers 30 are not then all withdrawn, and turning of the barrel 23 accordingly remains obstructed. After the initial turning of the key, further turning in the clockwise sense is in this case obstructed by abutment of the slot-flank 26 of the disc 21 with the lug 22 of the stationary barrel 23, and abutment also of the slot-flank 41 of the barrel 37 with the lug 38.

When the key is turned from its insertion position in the counter-clockwise sense (to lock the door), the barrel 23 in this case turns with it, and it is rotation of the barrel 37 that is obstructed by abutment of the tumbler 43 with one or other of the shoulders 48 of the cover 8. Abutment between the lug 38 and the slot-flank 40 is broken by the turning of the barrel 23, and the engagement of the key within the aperture 55 of the tumbler 43 displaces the tumbler 43 transversely with respect to the barrel 37. Provided the key is correctly cut with respect to its aperture-configuration, the tumbler 43 is withdrawn in response to turning of the key through twenty degrees, or less, from its insertion position. Once the tumbler 43 is withdrawn, the barrel 37 is free to turn with the key and the rest of the mechanism 1 in the counter-clockwise sense against the bias of the spring 42. The key can accordingly then be turned on to the full extent in the counter-clockwise sense to provide the deflection of the lever 9 necessary to lock the door. If, on the other hand, the cut of the key is incorrectly related to the aperture 55 of the tumbler 43, the tumbler 43 is not withdrawn and continues to obstruct turning of the barrel 37. This eventually obstructs full turning of the key and the rest of the mechanism 1 by abutment of the lug 38 of the barrel 23 with the slot-flank 41 of the stationary barrel 37.

Turning back of the key to its insertion position for withdrawal following either clockwise or counter-clockwise turning, restores the lock mechanism 1 to its initial condition. In particular, the engagement of the key within the apertures 54 of the tumblers 30 during return from clockwise turning, displaces the tumblers 30 transversely to project once again from the barrel 23 and obstruct clockwise turning. Similarly, engagement of the key within the aperture 55 of the tumbler 43 during return from counter-clockwise turning, displaces the tumbler 43 transversely to project from the barrel 37 to obstruct counter-clockwise turning once again.

The tumblers 30 and 43 and the key 5 are constructed in accordance with the principles described in U.K. Patent Specification No. 1,030,921, to provide different lock combinations or differs. It will be appreciated in this respect also that the number of differs can be changed by use of different numbers of tumblers with the barrels 23 and 37, from those described; in particular more than one tumbler may be used with the barrel 37.

With the lock described above, the spindle 7 (being integral with the barrel 37) does not rotate during initial turning of the key in the counter-clockwise (locking) sense; when turning is in the clockwise (unlocking) sense, on the other hand, it turns with the key through the initial, limited angular range of freedom from the insertion position. This latter limited turning of the spindle 7 and consequent deflection of the lever 9 (retained on it by a spring clip 56 and engaged by the lug 51), is in general of no disadvantage in relation to lock security. Unlocking operation of the door latch in the present instance requires deflection of the lever 9 through a much larger angle than involved in this initial freedom, but if this were not the case the lock could be readily modified to avoid it in the unlocking sense. More especially the barrels that are operative for unlocking (23) and locking (37) may be interchanged with one another so that the spindle 7 is then directly connected to the unlocking barrel rather than as in the above-described example, to the locking barrel.

I claim:

1. In a key-operable cylinder lock in which tumbler means projects from a barrel to obstruct rotation of the tumbler mechanism of the lock, and a key inserted into the tumbler mechanism engages with the tumbler means for withdrawal thereof by initial turning of the key in one direction from its position of insertion, the improvement wherein said tumbler means obstructs rotation of the barrel in the said one direction only, the said mechanism includes further tumbler means for obstructing rotational freedom of the mechanism in the opposite direction to said one direction, said further tumbler means being engaged by the inserted key for withdrawal thereof from its obstruction to said rotational freedom, and said tumbler mechanism includes means operative during the said initial turning of the key in said one direction to provide rotational slip relative to the barrel in said engagement of the key with said further tumbler means.

2. A lock according to claim 1 wherein said mechanism includes a further barrel carrying said further tumbler means, and lost-motion means intercoupling the two barrels.

3. A lock according to claim 2 wherein one of the two barrels has a slot therein and the other barrel has a lug projecting therefrom to engage in said slot to provide said lost-motion intercoupling between the two barrels.

4. A lock responsive to turning of an inserted key in opposite directions from its position of insertion, comprising first and second tumbler means, first and second rotatable barrels carrying said first and second tumbler means respectively, and means intercoupling the two barrels, said first tumbler means comprising at least one first tumbler for obstructing rotation of the first barrel with the key in a first only of said opposite directions and responsive to initial turning of the inserted key in said first direction from its position of insertion to withdraw that obstruction to rotation of the first barrel in said first direction, said second tumbler means comprising at least one second tumbler for obstructing rotation of said second barrel with the key in the second only of said opposite directions and responsive to initial turning of the inserted key in said second direction from its position of insertion to withdraw that obstruction to rotation of said second barrel in said second direction, and said intercoupling means including lost-motion coupling means operative between the two barrels to enable the first barrel to rotate with the key relative to the second barrel during said initial turning of the key in said second direction and the second barrel to rotate with the key relative to the first barrel during said initial turning of the key in said first direction.

5. A lock according to claim 4 wherein the second barrel has a slot therein and the first barrel has a lug that engages in said slot to provide said lost-motion intercoupling of the first and second barrels.

6. A lock according to claim 4 including casing means for the two barrels, said casing means having first and second shoulders to provide abutments for said first and second tumblers respectively.

7. A lock according to claim 6 wherein said casing means comprises a cylindrical casing having an open rear end, and a cover to close said rear end of the casing, and wherein the first and second shoulders are shoulders of said casing and said cover respectively.

8. A lock according to claim 4 including rotatable means defining a keyhole for receiving the inserted key and turning therewith, and lost-motion coupling means intercoupling the said keyhole-defining means with the first barrel to enable the said keyhole-defining means to rotate with the key relative to the first barrel during said initial turning of the key in said first direction.

9. A lock according to claim 4 or claim 8 including means for opposing resiliently rotation of the second barrel in both said first and second directions.

10. A lock according to claim 4 or claim 8 including additional means for providing resilient opposition to rotation of the two barrels in both said first and second directions, said additional means including a coiled spring having two ends and means to engage the two ends of the spring in response to rotation of the second barrel in the first and second directions respectively.

11. A lock according to claim 4 or claim 8 having an unlocked condition in response to turning of the key in said first direction and a locked condition in response to turning of the key in said second direction, wherein said first tumbler means comprises a plurality of said first tumblers and the number of said first tumblers is larger than the number of said second tumblers comprising said second tumbler means.

12. A key-operable cylinder lock responsive to turning of an inserted key in opposite directions from its position of insertion to effect locking and unlocking actions respectively of the lock, comprising:

a tumbler mechanism receiving the inserted key in operative engagement for turning in the locking and unlocking directions with the key, the tumbler mechanism comprising a barrel mounted for rotation in the locking and unlocking directions from the said key-insertion position, and withdrawable tumbler means carried by said barrel to obstruct rotation of the barrel from said key-insertion position in said unlocking direction only, said tumbler means engaging with said inserted key to respond to turning of the key in the said unlocking direction, said tumbler mechanism including means providing rotational slip between the barrel and the inserted key through initial turning of the inserted key in said unlocking direction from the key-insertion position, and said tumbler means responding to the initial turning of the inserted key in said unlocking direction from said key-insertion position to withdraw from obstructing rotation of the barrel in that direction;

and further means opposing rotation of the said tumbler mechanism in the said locking direction from said key-insertion position, said further means including spring means engaging with said mechanism to oppose resiliently rotation of said mechanism in at least said locking direction from said key-insertion position.

13. A key-operable lock according to claim 12 wherein said spring means comprises a coiled spring engaging said tumbler mechanism to oppose resiliently rotation of said mechanism in both said locking and unlocking directions from said key-insertion position.

14. In a key-operable cylinder lock in which tumblers act to obstruct rotation of a barrel of a tumbler mechanism of the lock, and a key inserted into the tumbler mechanism engages with the tumblers to withdraw them by initial turning of the key in one direction from its position of insertion so as thereby to enable further turning of the key in that same direction to effect unlocking, the improvement wherein the tumblers act to obstruct rotation of the barrel in the said one, unlocking, direction only, the barrel being free from obstruction for rotation in the opposite, locking direction from the position of key insertion without withdrawal of the tumblers, and spring means opposes resiliently rotation of the tumbler mechanism with the key in the locking direction from the position of key insertion.

15. A lock according to claim 14 including rotatable means defining a keyhole for receiving the inserted key and turning therewith, and lost-motion coupling means intercoupling the said keyhole-defining means with the barrel to enable the said keyhole-defining means to rotate with the key relative to the barrel during said initial turning of the key.

16. A lock according to claim 14 or claim 15 wherein said spring means is a coiled spring engaging said tumbler mechanism.

* * * * *